United States Patent [19]

Brooks

[11] Patent Number: 4,987,693

[45] Date of Patent: Jan. 29, 1991

[54] FIREARM SAFETY MECHANISM

[76] Inventor: Frank Brooks, 7689 S.E. Rivers Edge St., Jupiter, Fla. 33458

[21] Appl. No.: 202,988

[22] Filed: Jun. 6, 1988

[51] Int. Cl.[5] ..... F41A 17/04

[52] U.S. Cl. ..... 42/70.11

[58] Field of Search ..... 42/70.11

[56] References Cited

U.S. PATENT DOCUMENTS

| | | | |
|---|---|---|---|
| 2,803,910 | 8/1957 | Lyle . | |
| 3,199,240 | 8/1965 | Largen . | |
| 3,368,297 | 2/1968 | Lentz | 42/70.11 |
| 3,720,014 | 3/1973 | Goodrich | 42/70.11 |
| 3,735,519 | 5/1973 | Fox . | |
| 3,768,189 | 10/1973 | Goodrich | 42/70.11 |
| 3,939,679 | 2/1976 | Barker et al. . | |
| 4,003,152 | 1/1977 | Barker et al. . | |
| 4,014,123 | 3/1977 | Williams . | |
| 4,084,341 | 4/1978 | Cervantes . | |
| 4,291,481 | 9/1981 | Hillberg . | |
| 4,302,898 | 12/1981 | La Rue | 42/70.11 |
| 4,457,091 | 7/1984 | Wallerstein | 42/70.11 |
| 4,488,370 | 12/1984 | Lemelson . | |
| 4,499,681 | 2/1985 | Bako et al. . | |
| 4,682,435 | 7/1987 | Heitzel . | |
| 4,763,431 | 8/1988 | Allan et al. | 42/70.11 |

OTHER PUBLICATIONS

Beretta Serie 81, Operation Manual.

Smith & Wesson, Revolvers, Safety and Instruction Manual.

*Primary Examiner*—Harold J. Tudor

*Assistant Examiner*—Richard W. Wendtland

*Attorney, Agent, or Firm*—Eckert, Seamans, Cherin & Mellott

[57] ABSTRACT

A firearm safety mechanism includes a lock with engagement structure. The engagement structure has a locked position in which the engagement structure operatively engages a portion of the firing mechanism to prevent discharge of the firearm. The engagement structure also has an unlocked position permitting operation of the firing mechanism. The lock includes selection structure permitting movement of the engagement structure from the locked position to the unlocked position upon the reception of a predetermined selection criteria. The firearm can be locked against unauthorized use and unlocked by an authorized user without resort to external accessories.

22 Claims, 16 Drawing Sheets

FIG. 1
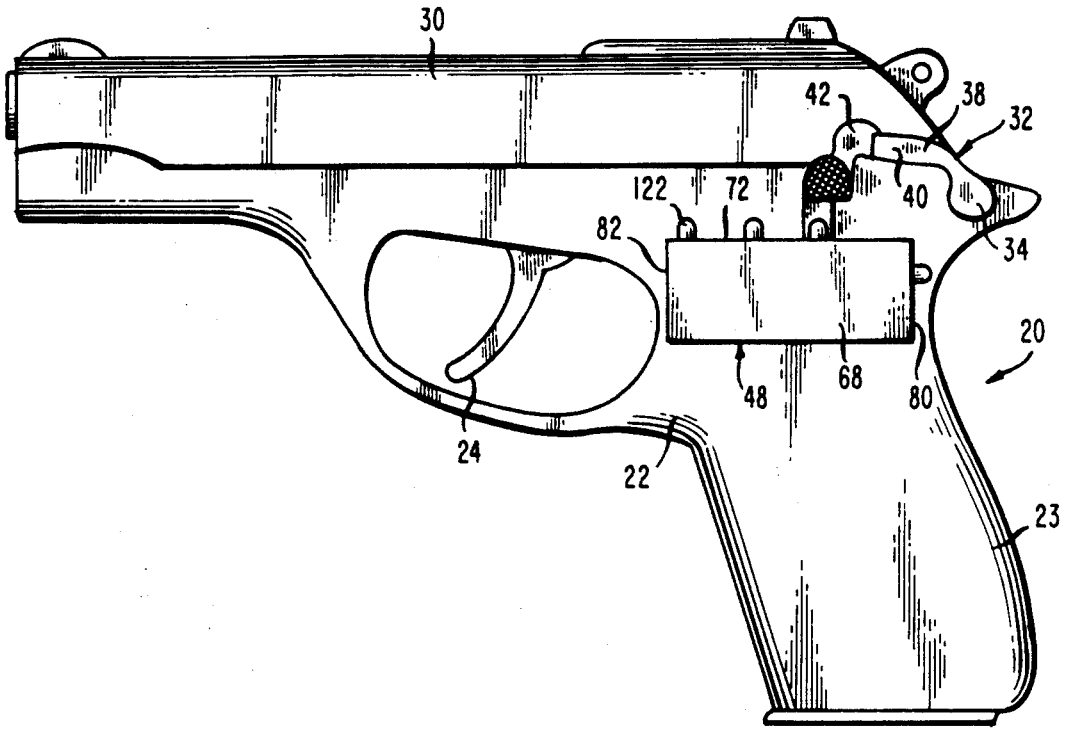
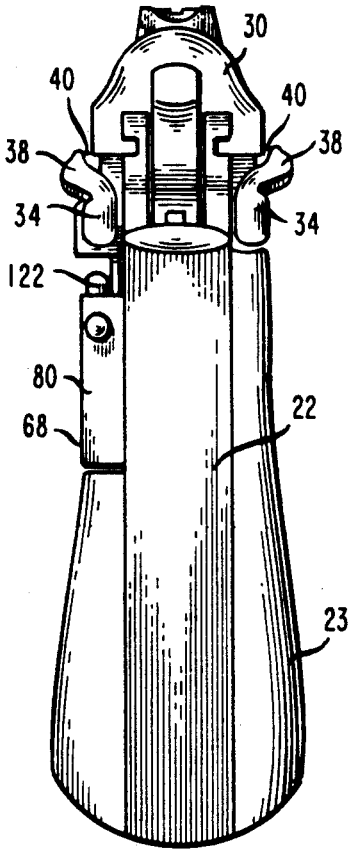
FIG. 2

FIREARM SAFETY MECHANISM

BACKGROUND OF THE INVENTION

1. Field of the Invention

This invention relates generally to firearms, and more particularly to firearm safety mechanisms.

2. Description of the Prior Art

There is continuing concern about the prevalence of handguns and other firearms in our society. One of the objections to firearms relates to the use of these weapons by unauthorized persons. Tragic accidents occur when children happen upon weapons, often in their own homes, and attempt to play with them. Most revolvers do not have a safety. The safety mechanisms that are found on firearms are not adequate to prevent injury, as curious children will often move the safety to the "off" position without their knowledge. A measure of safety can be obtained by removing the bullets from the weapon, but it is time consuming to load a weapon in an emergency situation and the danger exists that the gun will not be loaded when it is needed immediately.

Another alarming situation is encountered when unauthorized persons wrestle weapons from police officers or private citizens and turn them on the owner or others. The safety is only a slight impediment to firing the weapon, and at best gives the police officer or owner only an instant in which to retrieve the weapon.

A safety, if present on the handgun, should remain "on" much of the time. Policemen rarely draw their handguns, and often carry the weapons home during off-duty hours. Homeowners especially should leave firearms with the safety "on", particularly where children are present in the home.

A number of locking mechanisms have been devised to retard the unauthorized use of firearms. Locks have been created which attach to the trigger area of a firearm to prevent access to the trigger, and thus to render the weapon inoperable. Representative patents include Bako, et al, U.S. Pat. No. 4,499,681, and Cervantes, U.S. Pat. No. 4,084,341. These locks are cumbersome and difficult to remove from the weapon, even by the authorized user. This can reduce the effectiveness of the weapon in emergency situations. The police officer in immediate need of the weapon, or the private citizen who must use the weapon for self defense, cannot tolerate significant delays in rendering the weapon operable. External locks must also be carried when not attached to the weapon in order to keep the lock at hand. Other mechanical locks require keys which can be easily lost or misplaced and are difficult to manipulate in the dark.

Most mechanical locks are difficult or impossible to open without looking at the lock. These locks present problems at night, during emergency situations when the eyes cannot be taken from another person or object, or when the user might not have on glasses necessary for close-in vision.

Electronic locks for firearms have been devised. These mechanisms render the firearm operable or inoperable upon the reception of a suitable signal that is produced by a remote signal-generating unit carried by the authorized user. Examples of such devices are found in Heltzel, U.S. Pat. No. 4,682,435, and Lemelson, U.S. Pat. No. 4,488,370. These devices are not desirable insofar as the signal-generating device can be lost or misplaced by the authorized user, after which the locking mechanism will be inoperable. Also, dead batteries can render these devices useless.

Still another type of lock for a firearm is intended to prevent the accidental discharge of the weapon which sometimes occurs when the gun is dropped or jarred. Such a lock is disclosed by Largen, U.S. Pat. No. 3,199,240. These mechanisms typically involve a pressure-activated release that is provided in a portion of the firearm that is in contact with the user when the weapon is held in the firing position, such as in the butt of a gun stock or the hand grip of a handgun. The safety is deactivated when the release is moved by the placement of the gun stock against the shoulder or by grasping the hand grip. Should the weapon be dropped, relaxation of pressure on the release will automatically lock the weapon against accidental discharge. These locking mechanisms are effective only to prevent firing of the weapon when the gun is not positioned properly, and thus do not discriminate between authorized and unauthorized users.

It would be desirable to provide a weapon which could be locked against unauthorized use, yet readily activated by an authorized user. It would further be desirable if the locking mechanism would prevent accidental discharge of the weapon when it is dropped or jarred. It would also be desirable if the locking mechanism would require no external accessories, such that the authorized user could readily activate, or deactivate, the weapon at any time. It would also be desirable to provide a firearm which can be activated or deactivated without viewing the lock.

SUMMARY OF THE INVENTION

It is an object of the invention to provide a firearm safety mechanism which will render the weapon inoperable to unauthorized users.

It is another object of the invention to provide a firearm safety mechanism which will prevent firing of the weapon when it is accidentally dropped or jarred.

It is yet another object of the invention to provide a firearm safety mechanism which can be quickly activated or deactivated by the authorized user.

It is still another object of the invention to provide a firearm safety mechanism which will not require external accessories.

It is yet another object of the invention to provide a firearm safety mechanism which can be activated or deactivated without viewing the mechanism.

These and other objects are provided by a firearm safety mechanism with a lock having engagement structure adapted to operatively engage a portion of the firing mechanism to prevent discharge of the firearm. The engagement portion is moveable between a locked position rendering the firearm inoperable, and an unlocked position permitting operation of the firing mechanism.

Selective structure permits movement of the engagement portion of the lock between the locked position and the unlocked position upon the reception of a predetermined selective criteria The selective structure comprises at least one selection device accessible from the exterior of the firearm. The selection device preferably requires the user to perform discrete operations which transmit an element of a combination to the lock.

The term "discreet" operations as used herein, refers to a physical act which enters an element of the combination. Each discrete operation produces, upon completion, a non-visual indication that the discreet operation has been completed. Suitable indications include a resistance to movement, a sound or a vibration. The discreet operations permit the user to track the number of operations which have been performed without viewing the combination device. The combination can thereby be entered into the lock at night or while the eyes are directed at another object. The discrete operations can include such physical acts as depressing each of a plurality of buttons for a predetermined number of counts, or depressing a plurality of buttons in a proper sequential order, or depressing a button or rotating a combination dial, where rotation of the dial through a given angular distance produces a vibration to signal the user as to the number that has been entered.

The engagement structure of the lock can engage or block the movement of any portion of the firing mechanism. In revolvers, the engagement structure can be a stop member that has a locked position in which the stop blocks the path of the hammer of the revolver to prevent firing. The stop member can be moved out of the path of the hammer only by entering the proper combination to release the lock.

The lock mechanism of the invention can be retrofitted to existing handguns, and is especially adapted for use in combination with existing safety mechanisms on the weapon. Automatic weapons commonly have a slide mechanism that is operable to reject spent cartridges and to cock the hammer. A slide safety associated with the slide is pivotable between a position blocking rearward movement of the slide and a position permitting rearward movement of the slide. The safety mechanism of the invention can be fitted to the automatic firearm such that the engagement structure is capable of a locked position which abuts the slide safety and prevents the movement of this safety to the "off" position. The engagement structure can be moved from its abutment with the slide safety to permit movement of the slide safety only by entering the proper combination to the lock.

A preferred lock mechanism includes a number of code sprockets which are rotatably mounted to a support. Each sprocket includes a gate disk. Each gate disk has a channel formed inwardly from the edge of the disk. A slide member has protrusions that are adapted to mate with the channels formed in the gate disks. Movement of the slide member is prevented by the gate disks, which block the movement of the protrusions. The channels in the gate disks are aligned with the protrusions on the slide member only when each sprocket has been rotated a proper number of increments, corresponding to the appropriate combination.

Rotation of the sprocket is preferably brought about by depressing a button which is connected to a depending push rod that terminates in a foot. Each sprocket has a plurality of teeth distributed about its periphery. The foot of the push rod engages the teeth to cause rotation of the sprocket when the button is depressed. Each button is spring mounted to return to the initial position when pressure on the button is relaxed. The push rod is preferably flexible so that the foot can snap over the next succeeding tooth of the code sprocket as the button returns to the initial position.

The safety mechanism is released by depressing each button a preset number of increments to align the channel of the associated code sprocket with a corresponding protrusion on the slide member. The slide member can then be moved in the direction of the channels as the protrusions slide into the channels.

The gate disks can be mounted to the code sprockets by detachable mounting means such as a screw. The screw can be loosened to permit rotation of the gate disk relative to the sprocket. This will alter the alignment of the channel with the teeth of the sprocket, and thus the number of increments necessary to align the associated channel with the corresponding protrusion on the slide member to release the lock. The combination can thereby be changed by the user.

The lock is engaged by moving the engagement portion and slide member to the locked position. The code sprockets are rotated to a position in which the channels on the gate disks no longer align with the protrusions, thereby preventing movement of the slide member and the engagement portion to the unlocked position.

The sprockets are returned to a predetermined starting position so that the number of increments necessary to align the channels with the protrusions will be the same for each attempt. The code sprockets are biased for rotation, and a ratchet member prevents rotation under the influence of the bias. The ratchet members are biased into engagement with the teeth by biasing means such as a spring. A reset slide adjacent to and moveable with respect to the ratchet members and the push rods carries a number of cam pins. A ratchet member cam pin is positioned adjacent to each of the ratchet members. A push rod cam pin is positioned adjacent to each of the push rods. A reset button is provided for access by the user. Movement of the reset button will result in movement of the reset slide and the cam pins. The cam pins act to remove the ratchet members and push rods from their engagement with the sprocket teeth, so that the code sprockets are free to rotate under the influence of the spring bias. A stop pin provided on the back surface of each sprocket is adapted to contact a stop surface that is fixed relative to the sprocket so as to halt rotation of the sprocket in the same rotational starting position.

The invention is suitable for practice with existing firearms. A lock mechanism can be retrofitted to almost any existing firearm with a minimum of interference to the normal use and operation of the weapon. It would be desirable, however, to manufacture the weapon with the lock mechanism of the invention. The firearm could then be forged such that the lock mechanism is conveniently positioned within the handle or another open interior space of the weapon.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a side elevation of a handgun having a safety mechanism according to the invention.

FIG. 2 is a rear elevation.

DETAILED DESCRIPTION OF THE PREFERRED EMBODIMENTS

Figure 3:
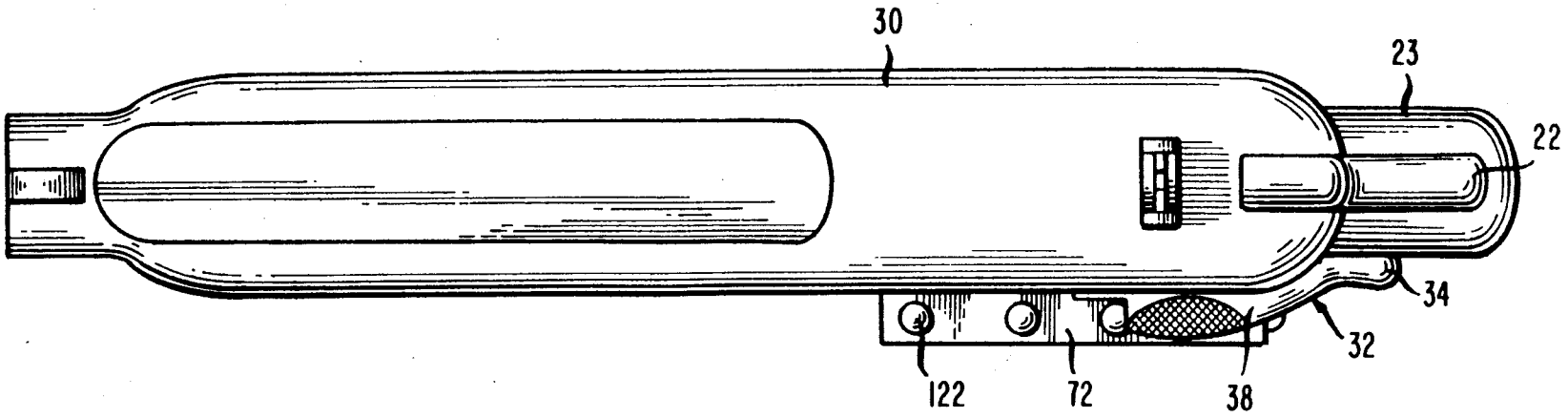
FIG. 3 is a plan view.

The safety mechanism of the invention can be used, with minor modification, in gun designs of many descriptions. The operation of most handguns is well understood, and described in several volumes including the Gun Digest Book of Firearms Assembly/Disassembly, Parts I and II, Automatic Pistols and Revolvers, by J. B. Wood, D.B.I. Books, Inc., Northbrook, Il., 1979; the S&W Revolver, A Shop Manual, Jerry Kuhnhavsen, V.S.P. Publishers, Department IA, Box 1966, Tusten, Calif. 92681; The Colt 45 Automatic, A Shop Manual, Jerry Kuhnhavsen, V.S.P. Publishers, Department IA, Box 1966, Tusten, Calif. 92681; and the NRA Guide to Firearms Assembly, National Rifle Association of America, 1600 Rhode Island Avenue, N.W., Washington, D.C., 20036. The disclosures of the above-identified references are herein fully incorporated by reference.

The use of the invention with such weapon, the Beretta model 84BB, manufactured by the Fabbrica d'ArmiPietro Beretta S.P.A. of Via Pietro Beretta, 18-25063 Gardone Val Trompia, Brescia, Italy, is shown in FIGS. 1–9. The weapon is fully described in the Owner's Manual Beretta dal 1526, series 81 hereby is fully incorporated by reference.

The automatic handgun indicated generally as 20 comprises a frame 22, a trigger 24, and a slide 30. The slide 30 must move to the rear of the weapon, in the direction of the hand grip 23 of the frame 22, in order for the weapon to fire. A safety 32 is standard with this weapon. The safety 32 is pivotally mounted to the frame 22 by a pair of base portions 34, one located on each lateral side of the handgun 20. An extension arm 38 extends forward from the base portions 34, and can have a scribed finger grip portion 40 to assist the user in manipulating the safety 32. The extension arms 38 are joined by a connecting rod 40 which extends laterally through the handgun from one extension arm 38 to the other. A groove 42 is formed in the base of the slide 30 immediately above the connecting rod 40. The safety 32 is pivoted about the base portion 34 to position the connecting rod 40 in the groove 42. Rearward movement of the slide 30 with respect to the grip 22 will thereby be prevented, as will operation of the firearm.

The safety mechanism of the invention is depicted as an add-on device suitable for retrofitting existing handguns. It will be understood, however, that the safety mechanism of the invention could be manufactured integrally as a part of a new handgun. The bulk of the device could then be substantially hidden from view within the frame 22 of the handgun.

Several lock designs are suitable for use with the invention. A suitable lock design will include an engagement structure adapted to operatively engage a portion of the firing mechanism to block firing of the weapon. The term "firing mechanism", as used herein, refers broadly to the parts of a weapon which must move in order to fire a round from the weapon. These typically include the trigger, hammer, and the sear on a revolver, and the trigger, and slide on a semi-automatic pistol. The parts which will comprise the firing mechanism can change from one firearm design to another, although the invention is useful for virtually any of these designs.

The engagement structure need not directly engage the firing mechanism, so long as an operative engagement is present. The engagement structure can, for example, block the path of movement of a component of the firing mechanism. The engagement portion can alternatively engage an existing safety mechanism on the weapon to prevent its deactivation by unauthorized users.

The lock 48 is a combination lock and the structure for entering the combination into the lock should produce a non-visual signal which allows the user to track the number that is entered as a combination to the lock. This can be accomplished by providing an entering device which requires discrete manual operations, so that the user can count the operations and know the combination number that has been entered into the lock without visual assistance. Suitable discrete manual operations for entering the combination include depressing buttons, touching an electronic keypad, and throwing a slide switch.

Figure 4:
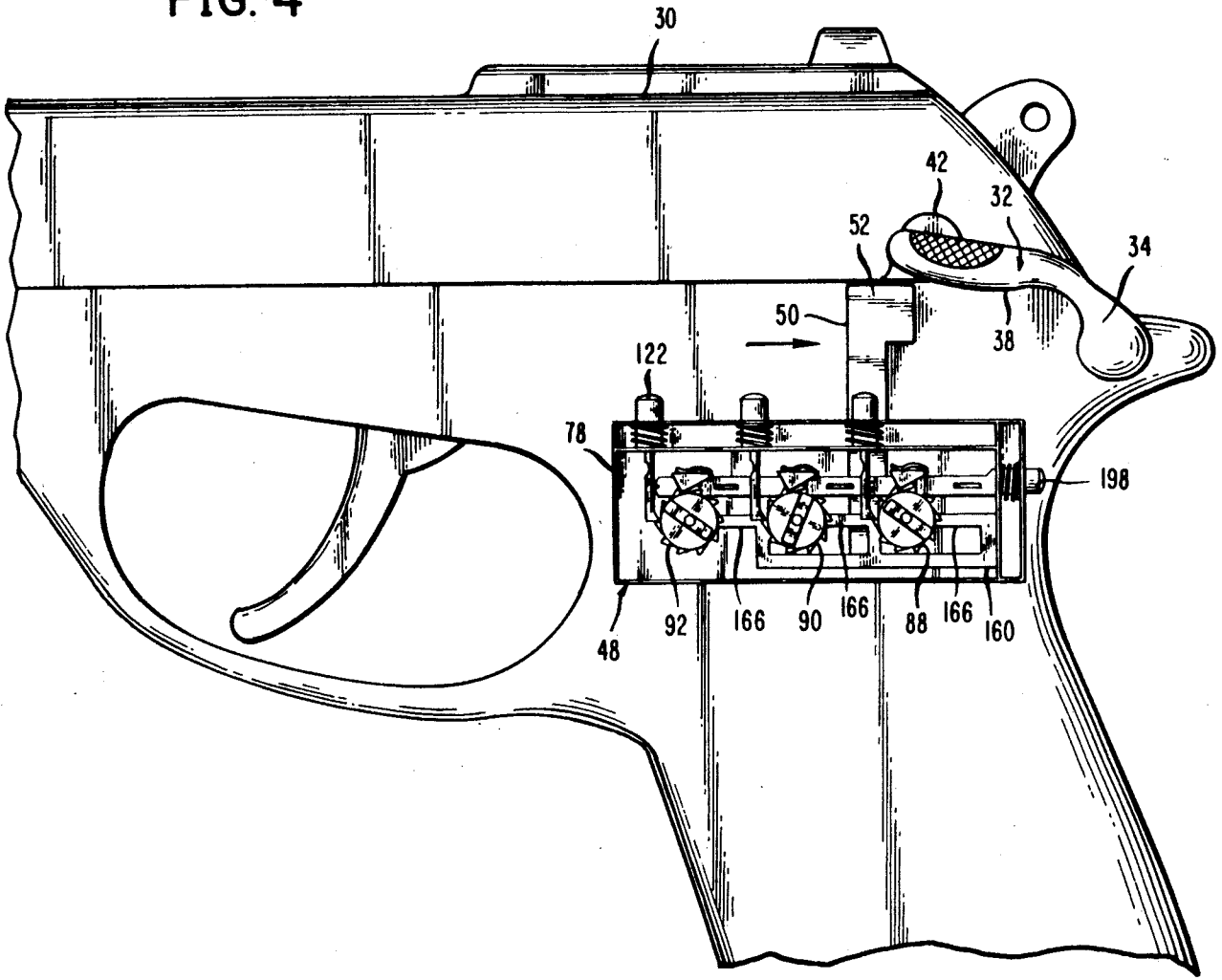
FIG. 4 is a side elevation with a front face of the housing of the lock removed.
Figure 5:
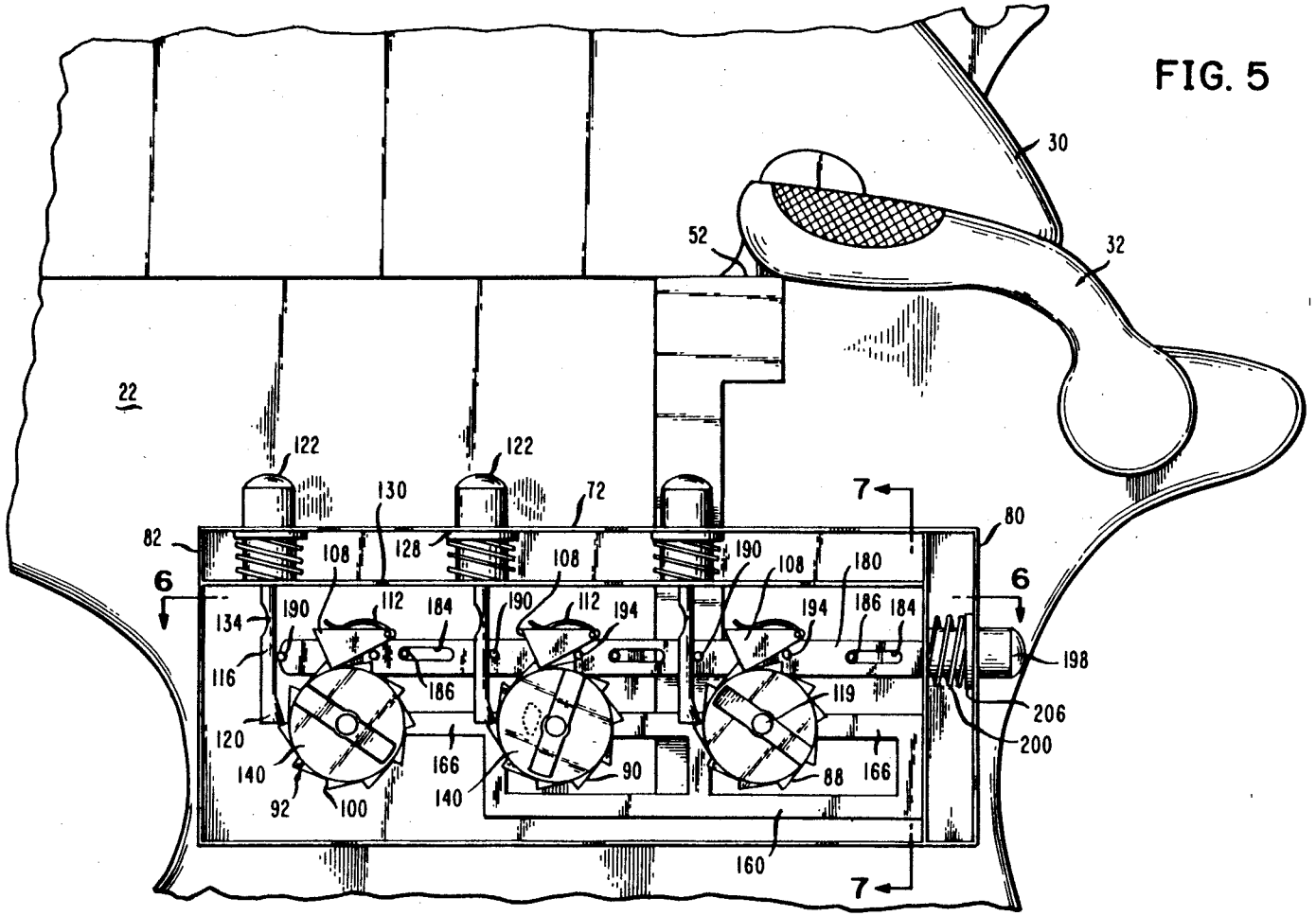
FIG. 5 is an enlarged view of FIG. 4.
Figure 7:
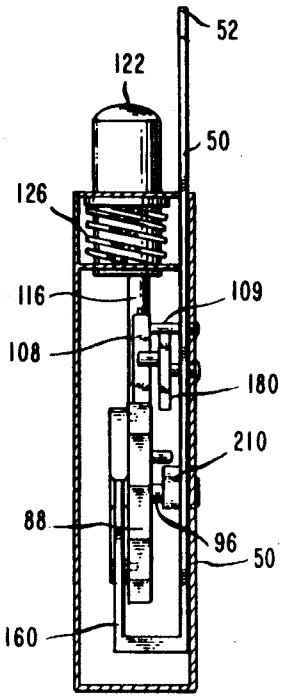
FIG. 7 is a cross-section through the lock mechanism taken along line 7—7 in FIG. 5.
Figure 6:
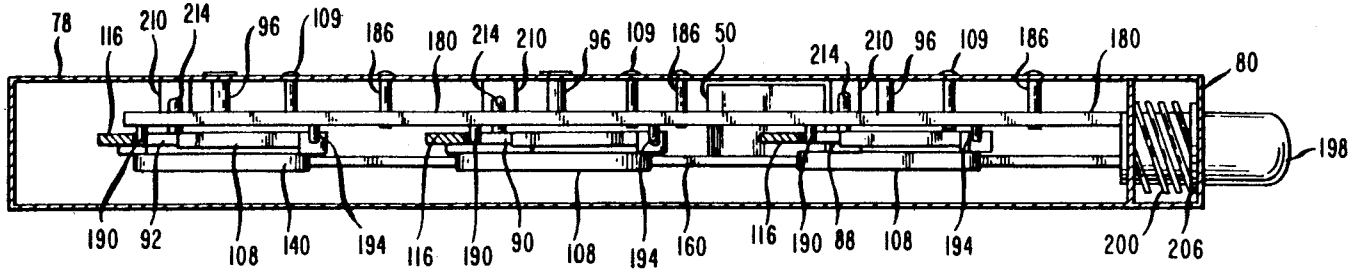
FIG. 6 is a cross-section through the lock mechanism taken along line 6—6 in FIG. 5.
Figure 8:
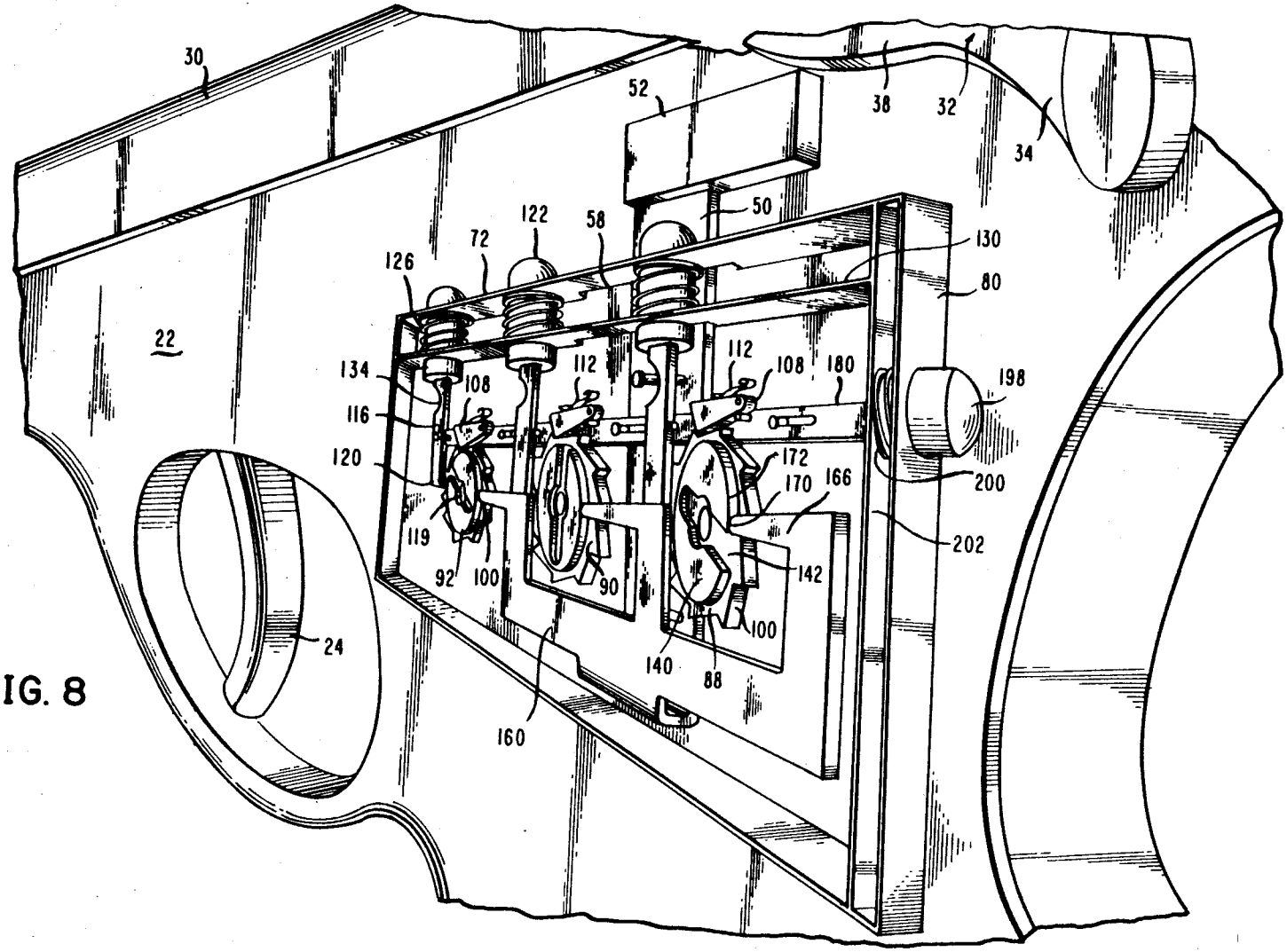
FIG. 8 is a perspective view of a lock mechanism according to the invention with a front face of the housing removed.

The lock 48 includes a locking bar 50 that can be substantially L-shaped to provide an extended upper edge portion 52. The locking bar 50 is slidably mounted through a slot 58 in the housing. In a first position the locking bar 50 is beneath the safety switch 38 of the handgun 20 (FIG. 4). The locking bar 50 will prevent movement of the safety switch 38 out of the groove 42 to the "safety-off" position. Upon reception of the proper combination to the lock 48, however, the locking bar 50 can be moved to an unlocked position (FIG. 9) away from abutment with the safety switch 32. The safety switch 32 can then be manipulated between the "safety-on" and "safety-off" positions in the usual manner when the lock 48 is in the unlocked position, and the handgun 20 can be operated in the usual manner to move the slide 30 rearward and cock the hammer 51.

Figure 11:
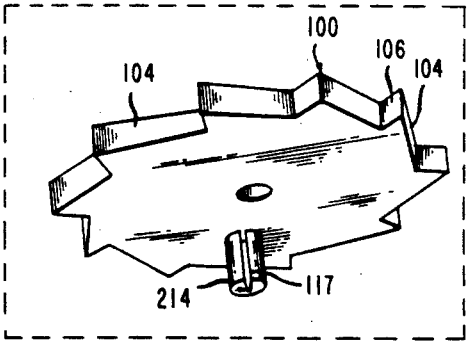
FIG. 11 is a perspective view of the back face of a code sprocket.
Figure 10:
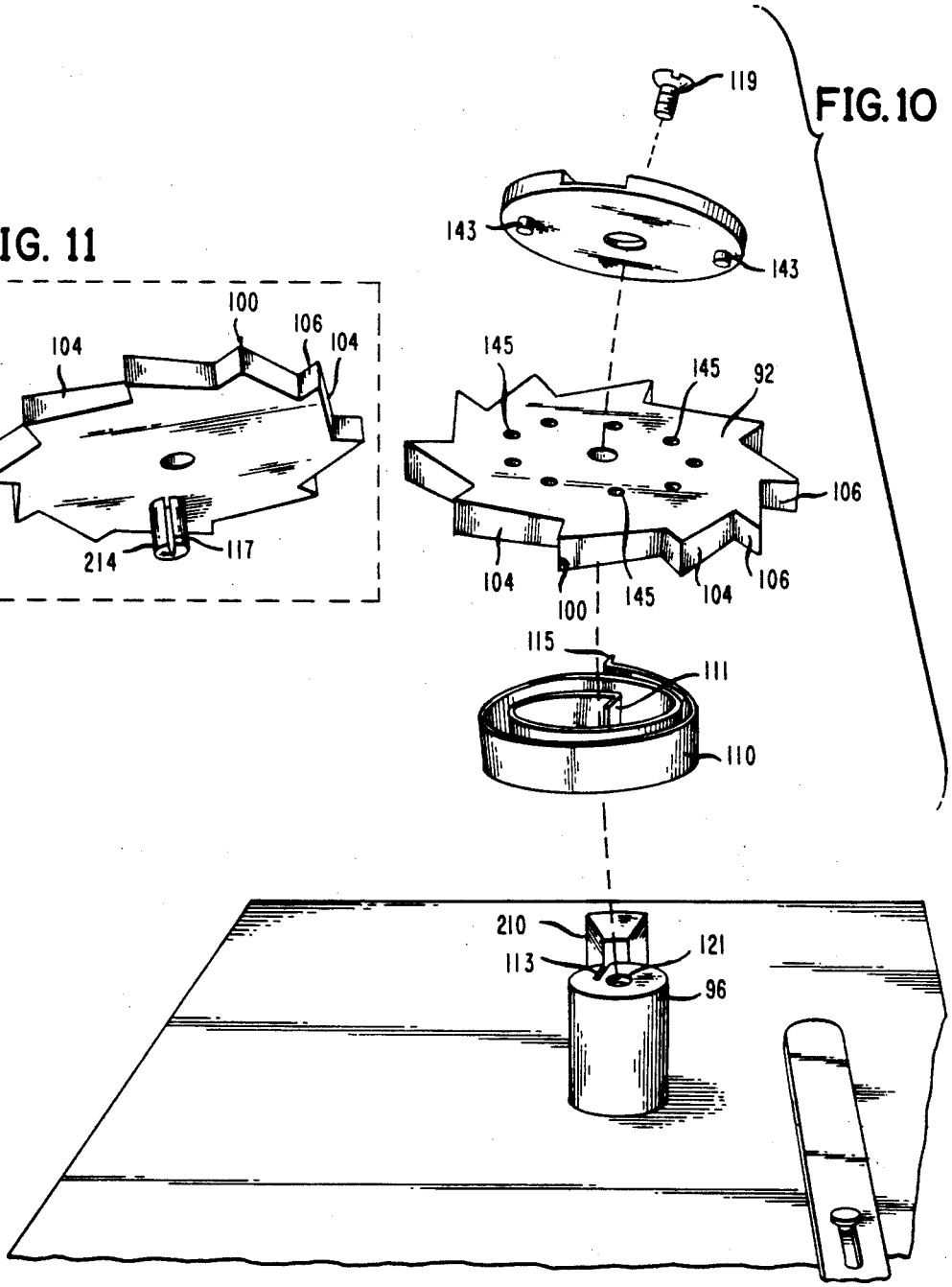
FIG. 10 is an exploded perspective view of a code sprocket assembly.
Figure 12:
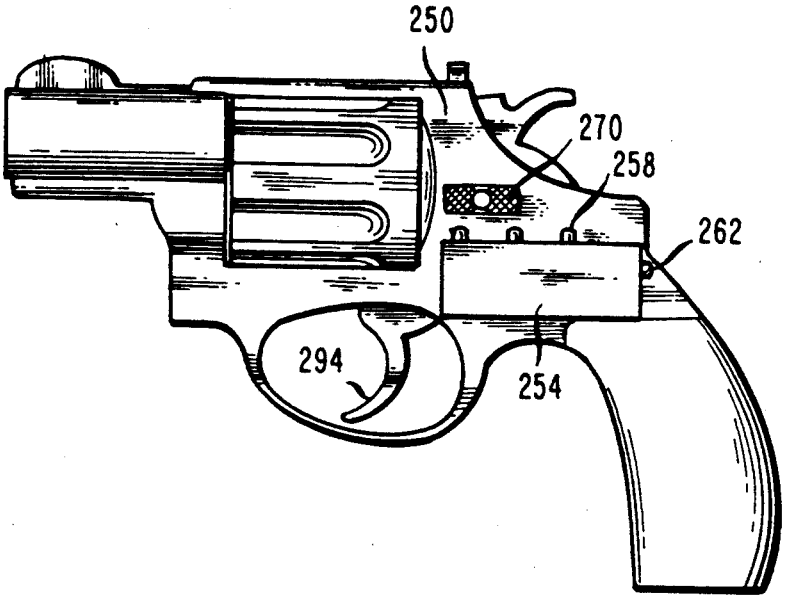
FIG. 12 is a side elevation showing a revolver with the safety mechanism of the invention.
Figure 13:
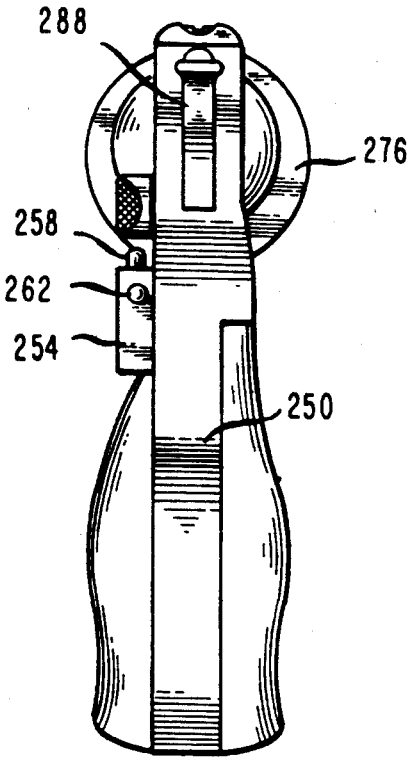
FIG. 13 is a rear elevation.
Figure 14:
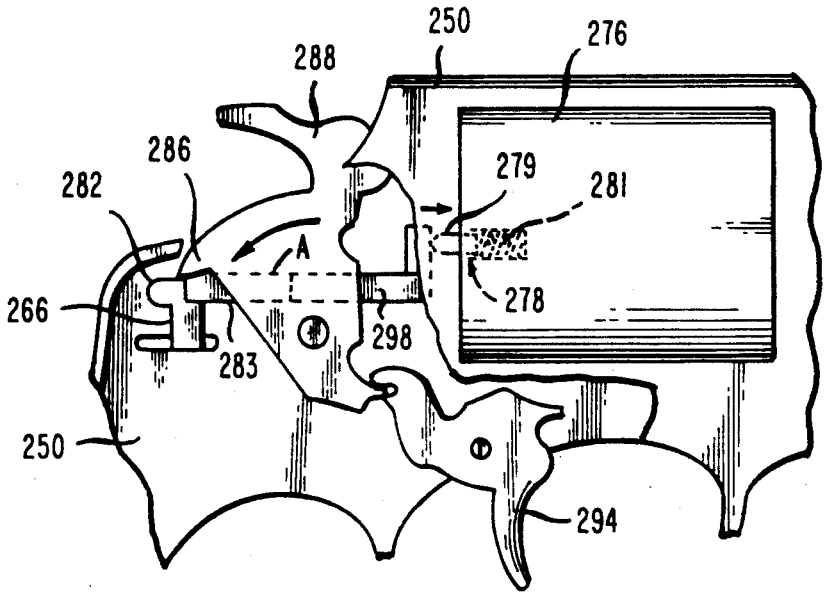
FIG. 14 is a side elevation, partially broken away and partially in phantom, in a first mode of operation.
Figure 15:
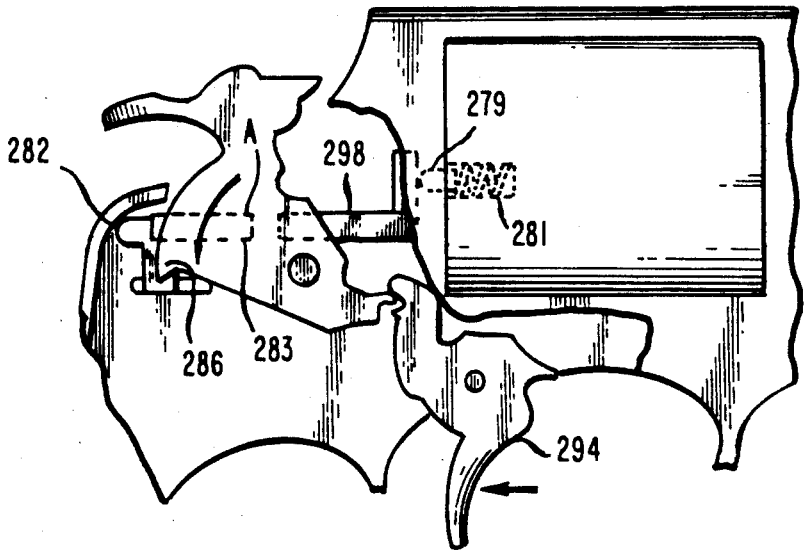
FIG. 15 is the side elevation of FIG. 14 but showing an alternate mode of operation.

One lock design that has been found suitable for practicing the invention is the lock 48 shown in the figures. The lock 48 includes a housing which is mounted to an exterior surface of the handgun 20 below the extension arm 38 of the safety 32. The housing includes a front face 68, a top face 72, a bottom face 74, a back face 78, and side faces 80, 82. At least one sprocket, and preferably three as shown, are rotatably mounted within the housing. Sprockets 88, 90, and 92 are rotatably mounted to the back face 78 about axles 96. The axles 96 are rotatably joined to the sprockets by any suitable bearing means. The sprockets 88, 90, 92, can be substantially disk-like, having a diameter in excess of the thickness of each sprocket, to minimize the space taken by the lock 48. Each of the sprockets has a plurality of sprocket teeth 100 (FIGS. 10, 11) disposed about the circumference of the sprocket. The sprocket teeth 100 preferably have an angular ramp portion 104 which slopes outwardly from the axis of rotation of the sprocket as defined by the axles 96. The ramp portion 104 terminates in a substantially planar notch surface 106.

Spring means such as the watch spring 110 are provided to bias the sprockets to rotate about the axles 96. An end 111 of the watch spring 110 can engage a slot 113 in the axle 96. Another end 115 of the watch spring 110 engages a slot 117 on a stop pin 214, to be described below. The sprockets can be rotatably fixed to the axles 96 by suitable fastening means such as the screw 119 which engages a threaded aperture 121 provided in the axle 96 The sprockets shown in the present embodiment are biased to rotate in the clockwise direction. Ratchet members 108 are provided to engage the notch surfaces 106 of the sprocket teeth 100 to prevent rotation under the bias of the watch spring 110. The ratchet members 108 are biased into a position of engagement with the sprocket teeth 100 by suitable biasing means such as the leaf springs 112. The ratchet members 108 can be pivotally mounted to the back face 78 of the housing about mounting pins 109.

Rotation of the sprockets can be accomplished by a push rod 116 having at one end a foot 120 adapted to engage the sprocket teeth 100. The push rod 116 is tangentially aligned with the sprockets in such manner that axial movement of the push rod will engage the foot 120 with the notch surface 106 of the sprocket teeth 100 to rotate the sprocket about the axle 96. A button head 122 is fixed to an end of the push rod 116 opposite to the foot 120 and extends through a top surface 72 of the housing for manipulation by the user.

The throw of the push rod 116 is at least equal to the length of one of the sprocket teeth 100. Rotation of the sprocket will cause the ratchet member 108 to travel over the ramp surface 104 against the bias of leaf spring 112 and subsequently to engage the notch surface 106 of the next succeeding tooth 100. The push rod 116 is biased toward its original position by a coil spring 126, which is disposed between a flange 128 on the button 122 and an inside surface 130 of the housing. When pressure on the button head 122 is relaxed, the spring 126 will return the push rod 116 to its original position. The push rod 116 can have a thinned portion 134 which permits the push rod 116 to spring outward over the ramp surface 104 of the succeeding tooth as the sprocket rotates. The push rod 116 will spring inward as it passes the notch surface 106 of the succeeding tooth, and will be positioned for another throw. The sprocket is thereby incrementally rotated by the discrete operations of the push rod 116, so that the operator can count to the number that is entered into the look for that button.

The combination required to open the lock is determined by the position of gate disks 140. One disk 140 is fixed to each sprocket. The disks 140 can be substantially planar and fixed to the code sprockets in a side by side arrangement to provide a compact design. Each disk 140 includes a gate channel 142. The channels 142 extend inwardly from the circumference of the disks 140. The disks 140 can be rotated relative to the sprockets by loosening the screw 119. Circumferentially disposed pins 143 (FIG. 10) can be provided on a back surface of the disk 140 to engage recesses 145 formed in the code sprocket in a circumferential arrangement so that the channel 142 will always be precisely aligned with respect to the sprocket teeth 100.

Figure 9:
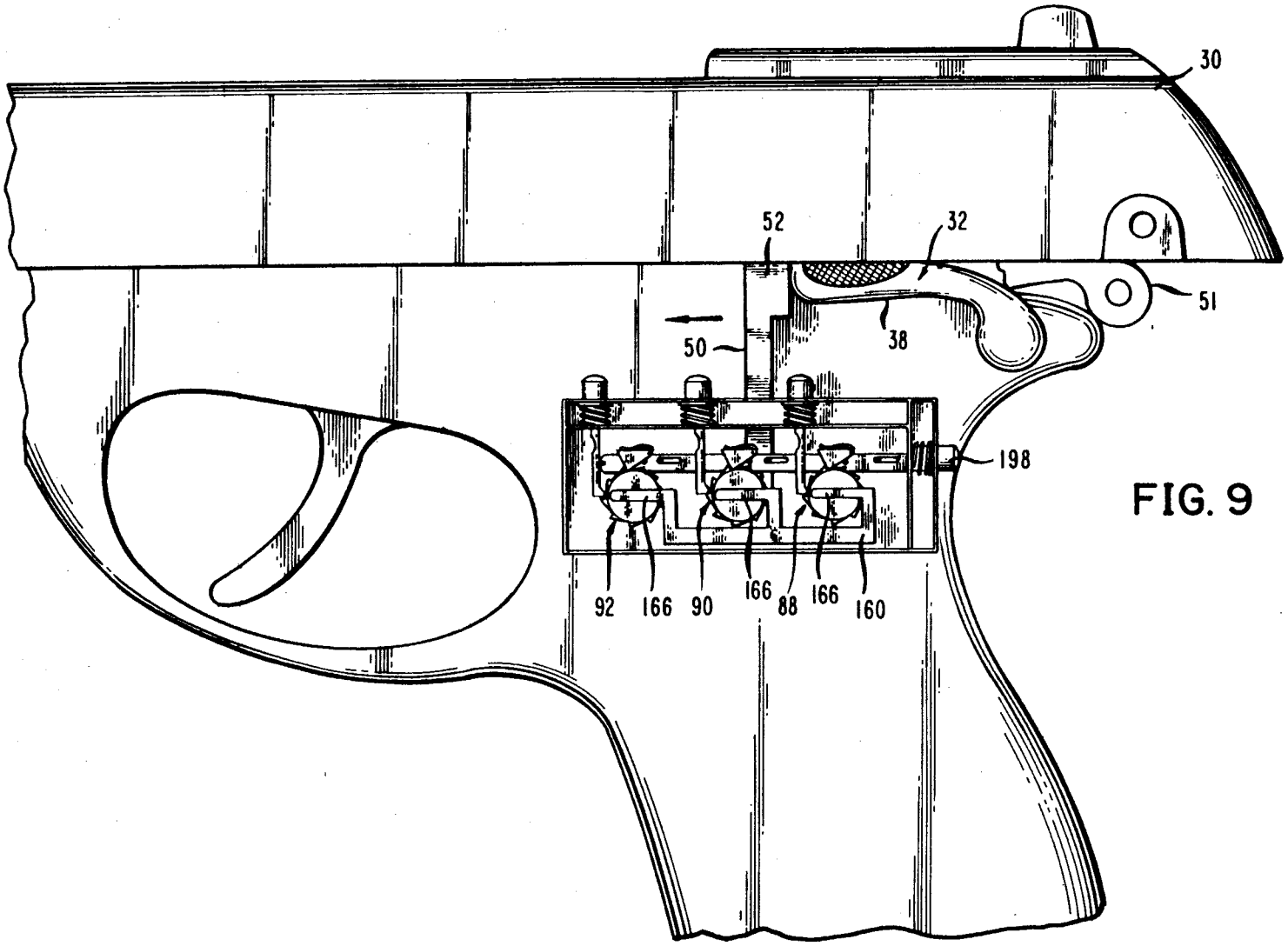
FIG. 9 is a side elevation similar to FIG. 4 but showing an alternative mode of operation.

The locking bar 50 is engaged to a slide member 160. The slide member 160 includes locking protrusions 166, one of which is associated with each disk 140. The protrusions 166 are substantially coplanar with the disks 140. Ends 170 of the protrusions 166 abut the circumferential edge 172 of the disks 140. Operation of the push rods 116 will rotate the sprockets in increments corresponding to the teeth 100. A given number of discrete operations of the push rods 116 for each button 122, equivalent to the combination, will align the channels 142 with the protrusions 166. The left hand sprocket in FIG. 4 will require six operations for alignment to occur, while the center sprocket will require eight operations and the right hand sprocket will require only one operation. When each of the buttons 122 has been depressed the proper number of times, all of the channels 142 will align with the protrusions 166. The protrusions 166 will then be free to slide into the channels 142 (FIG. 9). The slide member 160 and the locking bar 50 can then be moved from beneath the safety switch 32, whereupon the safety switch 32 can be operated in the usual manner.

It is desirable for the present embodiment that the operator be able to repeatedly initialize the sprockets to the same starting position relative to the push rods 116. The operator may inadvertently enter the wrong number into the device, or may lose count of the number that has been entered. The combination must be reentered. The operator may start over by returning the sprockets to a "zero" position and repeating the process of entering the combination. This can be accomplished by the provision of structure adapted to move the ratchet members 108 and push rods 116 from engagement with the sprocket teeth 100 so that the sprockets can rotate under the bias of the watch spring 110.

An elongated reset arm 180 can be slidably mounted within the housing in an adjacent alignment with the push rods 116 and the ratchet members 108. The reset arm 180 can have slots 184 which can be axially aligned with the long axis of the reset arm 180. Pins 186 can be fixed to the back face 78 of the housing. The reset arm 180 can then slide past the mounting pins 186 and relative to the ratchet members 108 and push rods 116.

A plurality of push rod cam pins 190 are fixed to the reset arm 180 so as to be substantially adjacent to the push rods 116. A plurality of ratchet member cam pins 194 are fixed to the reset arm 180 so as to be substantially adjacent to the ratchet members 108. The push rod cam pins 190 and ratchet member cam pins 194 extend outwardly from the reset arm 180 such that they contact the push rods 116 and the ratchet members 108 when the reset arm 180 is moved axially through the housing.

The reset arm 180 extends through the side face 80 of the housing, and is fitted with a button head 198 for manipulation by the user. A spring 200 is disposed between a seat 202 in the housing and a flange 206 on the button head 198. The spring 200 is adapted to bias the reset arm 180 to the sliding position where the push rod cam pins 190 and the ratchet member cam pins 194 are substantially removed from contact with the push rods 116 and the ratchet members 108, respectively, or to the right in FIG. 5.

The reset function is performed by depressing the reset button 198. This moves the push rod cam pins 190 and ratchet member cam pins 194 into contact with the push rods 116 and ratchet members 108, respectively. The push rods 116 are moved to the left in FIG. 5 and the ratchet members 108 are moved upward by the motion of the cam pins, to a position out of contact with the sprocket teeth 100. The sprockets can then rotate under the bias of the watch springs 110 to the starting position. Rotation of the sprockets is halted by stop surfaces 210 which project outwardly from the back face 78 of the housing. Stop pins 214 project outwardly from the sprockets and are positioned on the sprockets so as to engage the stop surfaces 210 when the sprockets have returned to the starting position. The sprockets will then be rotated back to the same starting position each time the reset button 198 is depressed. The operator may then re-enter the combination.

The foregoing is an illustration of but one embodiment of the invention, suitable for use with an automatic handgun. The invention can also be adapted for use with a variety of other types of weapons, including revolvers. One an embodiment is depicted schematically in FIGS. 12–15 for a typical revolver such as that manufactured by the Smith & Wesson Co. of 2100 Roosevelt Avenue, Springfield, Mass. and described in the Safety & Instruction Manual, Revolvers, 1987 and distributed by the company, the disclosure of which is hereby incorporated by reference. A revolver frame 250 is shown with a lock 254 according to the invention fixed to an outside surface of the frame 250. The lock 254 can be a self-contained unit as described above, with a plurality of combination buttons 258 and a reset button 262. A locking bar 266 extends inwardly and upwardly from the lock 254 through a slot 268 in the frame 250.

In most revolvers, a thumb piece 270 is operable to release a cylinder 276 of the weapon from the frame 250. A slide switch 278 comprising a knob 279 biased by a spring 281 is provided on the cylinder 276 and engages the frame 250 of the revolver to retain the cylinder in alignment with the frame 250. In the present invention, the thumb piece 270 is fixed to a locking bar extension 283 at an area A through a suitable slot (not shown) in the frame 250, so as to permit the user to manipulate the locking bar 266. A bolt 298 is slidably mounted within the frame 250 in alignment with the slide switch 278. Movement of the thumb piece 270 operates to move the locking bar extension 283 into contact with the bolt 298 and to depress the knob 279, and thus to release the cylinder 276 from the frame 250.

A hammer stop 282 on the locking bar 266 is adapted to engage or block the path of a protrusion 286 of the hammer 288 of the weapon. The trigger 294 cannot be moved to pivot the hammer 288 in the usual manner to fire the weapon because the hammer stop 282 is positioned in the path of the protrusion 286. According to the invention, movement of the locking bar 266 and hammer stop 280 and tang 282 from abutment with the projection 286 of the hammer 288 by manipulation of the thumb piece 270 is prevented by the lock. The locking bar 266 can be moved toward the rear of the weapon, and thus away from its locked position in the path of the protrusion 286, only upon the reception of the appropriate combination in the lock 254.

The lock described in the above embodiments of the invention requires the user to enter a combination selection in the form of a predetermined number of discrete depressions of each button. Other combination selections are contemplated. For example, the combination could require the user to depress a plurality of buttons in a proper sequential order. Other types of lock mechanisms are also known in the art, and are within the scope of the present invention.

This invention can be embodied in several forms without departing from the spirit or essential attributes thereof, and accordingly, reference should be made to the following claims, rather than to the foregoing specification, as indicating the scope of the invention.

I claim:

1. A firearm safety lock, comprising:

combination entering means accessible from the exterior of the weapon;

an engagement portion movable between a locked position in which the engagement portion operatively engages a movable portion of the firing mechanism to prevent discharge of the firearm, and an unlocked position permitting operation of the firearm;

at least one lock member disposed between the combination entering means and the engagement portion, the lock member being adapted to prevent movement of the engagement portion from the locked position to the unlocked position, the lock member being movable to a position where movement of the engagement portion to the unlocked position is permitted, and comprising at least one sprocket having a plurality of sprocket teeth, said combination entering means being adapted to engage said sprocket to cause rotation thereof, the engagement portion comprising at least one protrusion adjacent to each sprocket, each sprocket having channel means, movement of said sprocket by said combination entering means a predetermined number of times aligning said channel means with said protrusions, whereby said protrusions can be moved into said channel means and said engagement portion can be moved from the locked position to the unlocked position.

2. The firearm safety lock of claim 1, wherein said channel means are provided in a channel disk, one channel disk affixed to each sprocket.

3. The firearm safety lock of claim 2, wherein the channel disks are moveable with respect to said sprockets, whereby a relative position of the channel means to the sprocket can be varied to alter the number of operations of the combination entering means necessary to align the channel means with the protrusions.

4. The firearm safety lock of claim 1, wherein the combination entering means comprise push rods, one of said push rods being associated with each sprocket, operation of the push rods being adapted to rotate the sprocket.

5. The firearm safety lock of claim 4, further comprising means for biasing said sprockets for rotation about an axis, and ratchet means, said ratchet means being adapted to engage said sprocket teeth to prevent rotation of said sprockets under the influence of said biasing means, and ratchet biasing means adapted to bias said ratchet members into engagement with said sprocket teeth.

6. The firearm safety lock of claim 5, further comprising reset means, the reset means being adapted to move said push rods and said ratchet members from contact with said sprocket means, whereby rotation of said sprockets by said sprocket biasing means will be substantially unimpeded, and stop means on said sprocket and a stop surface on said firearm, said stop means on said sprocket being adapted to engage the stop surface on said firearm to halt rotation of said sprockets at a predetermined starting position.

7. The firearm safety lock of claim 6, wherein said reset means comprises a reset slide member being slidably mounted adjacent to said ratchet members and said push rods, said reset slide member having a plurality of cam pins, whereby movement of said reset slide will cause movement of said cam pins into contact with said push rods and said ratchet members to disengage said push rods and said ratchet members from contact with said sprocket teeth.

8. The firearm safety lock of claim 7, wherein said push rods have hinge means permitting movement of a portion of said push rods with contact by said cam pin.

9. The firearm safety lock of claim 6, wherein said engagement portion comprises a locking bar, said locking bar being adapted to abut a portion of the firing mechanism which must move to fire the weapon, thereby preventing operation of the firearm.

10. A firearm safety lock for attachment to exterior surfaces of firearms having an external safety mechanism moveable between at least "safe" and "unsafe" positions for preventing and enabling, respectively, operation of the firearm, said firearm safety lock comprising;

a housing, and means for attaching the housing to said firearm so as to be external to said firearm upon installation;

a lock opening device external to said firearm upon installation and assessable from the exterior of the housing;

an engagement portion external to said firearm upon installation, said engagement portion extending through the housing and being positionable between a locked position in which the engagement portion operatively engages said external safety mechanism to prevent movement of said safety mechanism to said "unsafe" position, and to thereby prevent discharge of the firearm, and an unlocked position permitting said safety mechanism to be moved to said "unsafe" position and thereby operation of the firearm; and, lock means within said housing and external to said firearm upon installation, said lock means being operatively disposed between said lock opening device and said engagement portion, the lock means being adapted to selectively permit and prevent movement of the engagement portion between the locked and unlocked positions, said lock means being adapted to permit movement of said engagement portion to said unlocked position upon proper operation of said lock opening device.

11. The firearm safety lock of claim 10, wherein said lock means is a combination lock, and said lock opening device comprises combination entering means, whereby operation of said external safety mechanism will be restricted to users having an appropriate combination.

12. The firearm safety lock of claim 11, wherein said lock member comprises a sprocket having a plurality of sprocket teeth, said combination entering means being adapted to engage said sprocket to cause rotation thereof.

13. The firearm safety lock of claim 12, wherein the engagement portion comprises at least one protrusion adjacent to each sprocket, each sprocket having channel means formed in an exterior surface of said sprocket, movement of said sprocket by said combination entering means a predetermined number of times aligning said channel means with said protrusions, whereby said protrusions can be moved into said channel means and said engagement portion can be moved from the locked position to the unlocked position.

14. The firearm safety lock of claim 13, wherein said channel means are provided in a channel disk, one channel disk being affixed to each sprocket.

15. The firearm safety lock of claim 14, wherein the channel disks are movable with respect to said sprockets, whereby a relative position of the channel means to the sprocket can be varied to alter the number of operations of the combination entering means necessary to align the channel means with the protrusions.

16. The firearm safety lock of claim 13, wherein the combination entering means comprise push rods, one of said push rods being associated with each sprocket, operation of the push rods being adapted to rotate the sprocket.

17. The firearm safety lock of claim 16, further comprising means for biasing said sprockets for rotation about an axis, and ratchet means, said ratchet means being adapted to engage said sprocket teeth to prevent rotation of said sprockets under the influence of said biasing means, and ratchet biasing means adapted to bias said ratchet members into engagement with said sprocket teeth.

18. The firearm safety lock of claim 17, further comprising reset means, the reset means being adapted to move said push rods and said ratchet members from contact with said sprocket means, whereby rotation of said sprockets by said sprocket biasing means will be substantially unimpeded, and further comprising stop means on said sprocket and a stop surface on said firearm, said stop means on said sprocket being adapted to engage the stop surface on said firearm to halt rotation of said sprockets at a predetermined starting position.

19. The firearm safety lock of claim 18, wherein said reset means comprises a reset slide member being slidably mounted adjacent to said ratchet members and said push rods, said reset slide member having a plurality of cam pins, whereby movement of said reset slide will cause movement of said cam pins into contact with said push rods and said ratchet members to disengage said push rods and said ratchet members from contact with said sprocket teeth.

20. The firearm safety lock of claim 19, wherein said push rods have hinge means permitting movement of a portion of said push rods when contacted by said cam pin.

21. The firearm safety lock of claim 18, wherein said engagement portion comprises a locking bar, said locking bar being adapted to abut a portion of the firing mechanism which must move to fire the weapon, thereby preventing operation of the firearm.

22. The firearm safety lock of claim 11, further comprising reset means adapted to return said combination lock means to a predetermined starting position.

* * * * *